US011203108B2

(12) United States Patent
Tsai

(10) Patent No.: US 11,203,108 B2
(45) Date of Patent: Dec. 21, 2021

(54) GRIP DEVICE FOR HEXAGONAL WRENCHES

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 319 days.

(21) Appl. No.: 16/447,965

(22) Filed: Jun. 21, 2019

(65) Prior Publication Data

US 2020/0398418 A1 Dec. 24, 2020

(51) Int. Cl.

| | |
|---|---|
| ***B25G 1/06*** | (2006.01) |
| ***B25B 23/16*** | (2006.01) |
| ***B25G 3/24*** | (2006.01) |
| ***B25B 15/00*** | (2006.01) |

(52) U.S. Cl.

CPC ..... *B25G 1/063* (2013.01); *B25B 15/008* (2013.01); *B25B 23/16* (2013.01); *B25G 3/24* (2013.01)

(58) Field of Classification Search

CPC ..... B25G 3/24

See application file for complete search history.

(56) References Cited

U.S. PATENT DOCUMENTS

| | | | | |
|---|---|---|---|---|
| 2,569,069 A * | 9/1951 | Motel | ..... | B25G 1/005 81/177.2 |
| 2,715,028 A * | 8/1955 | Dossie | ..... | B25B 13/56 81/177.4 |
| 6,791,291 B2 | 9/2004 | Shimizu et al. | | |
| 10,618,158 B2 * | 4/2020 | Liu | ..... | B25G 1/005 |

* cited by examiner

*Primary Examiner* — Hadi Shakeri

(57) ABSTRACT

A grip device for hexagonal wrenches includes a body, a rotary member, a resilient member and a fastening member. The body includes an engaging portion which includes multiple recesses, multiple first slots and an axle. The rotary member is rotatably and movably mounted to the axle. The rotary member includes a first room defined in the inner periphery of the passage through which the axle extends. A first shoulder is formed between the first room and the passage. The resilient member is mounted to the axle and the fastening member is connected to the axle. An L-shaped tool has the first section thereof received in one of the recesses and the first slot of the recess. When the rotary member is moved toward the engaging portion, the first section is inserted into the first slot. The L-shaped tool is restricted by the rotary member and used as a T-bar tool.

7 Claims, 10 Drawing Sheets

GRIP DEVICE FOR HEXAGONAL WRENCHES

BACKGROUND OF THE INVENTION

1. Fields of the Invention

The present invention relates to a grip device, and more particularly, to a grip device which accommodates hexagonal wrenches therein which are secured to the grip device by rotating a rotary member.

2. Descriptions of Related Art

The conventional connection compensating device of multi-angular wrench socket is disclosed in U.S. Pat. No. 6,791,291, and comprises a main body which is a cylindrical body. The outer circumference of the main body between two ends thereof is formed with several radially arranged flutes which extend along the circular axis of the main body by a certain length. The flutes have different cross-sectional areas. A connecting section includes a first tubular body fitted around the main body. The first tubular body is rotatable about the circular axis of the main body. The first tubular body is partially overlaid on the flutes. A geometric central axis of the profile of inner circumference of the first tubular body is not coincided with the circular axis of the main body.

However, when the hexagonal wrench is installed to the flute of the main body and the inner circumference of the first tubular body, the hexagonal wrench is likely to slip off from the flute when being rotated, unless the user's finger contacts the lateral side of the hexagonal wrench. Nevertheless, this makes the operation of the hexagonal wrench awkward and inconvenient.

The present invention intends to provide a grip device that eliminates the shortcoming mentioned above.

SUMMARY OF THE INVENTION

The present invention relates to a grip device for hexagonal wrenches and comprises a body, a rotary member, a resilient member and a fastening member. The body includes an engaging portion which includes multiple recesses, multiple first slots and an axle. The rotary member is rotatably and movably mounted to the axle. The rotary member includes a first room defined in the inner periphery of the passage through which the axle extends. A first shoulder is formed between the first room and the passage. The resilient member is mounted to the axle and the fastening member is connected to the axle. The resilient member and the fastening member are located in the first room. The resilient member is biased between the first shoulder and the head of the fastening member. An L-shaped tool has the first section thereof received in one of the recesses and the first slot of the recess. When the rotary member is moved toward the engaging portion, the first section is inserted into the first slot. The rotary member is rotated so as to seal the end opening of the recess so that the L-shaped tool is restricted by the rotary member and is not separated from the body. The users hold the body to rotate the L-shaped tool.

The rotary member is biased by the resilient member and firmly contacts the body so that when rotating the body, the rotary member is not shifted relative to the body.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
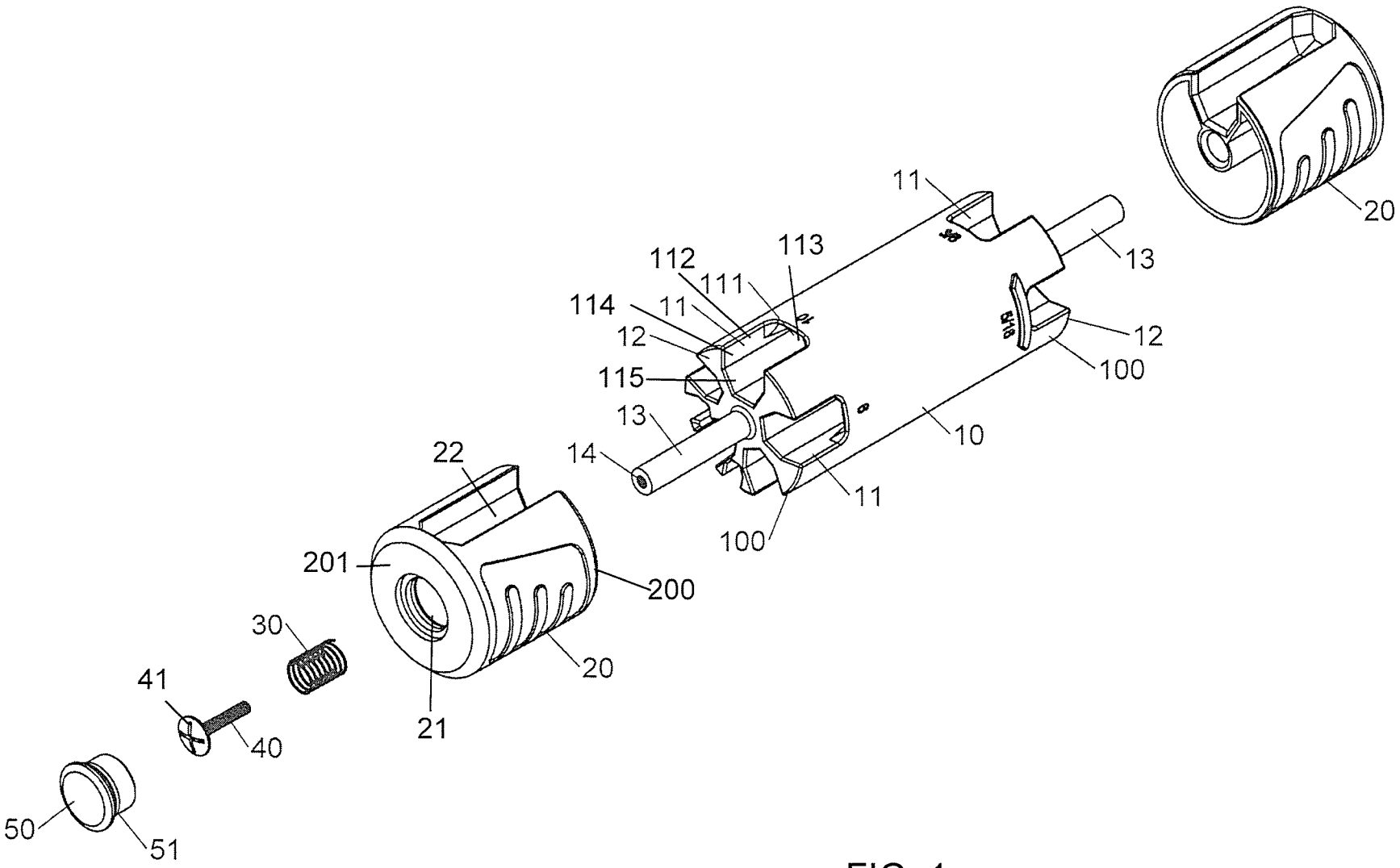
FIG. 1 is an exploded view of the grip device of the present invention.

Referring to FIGS. 1 to 6, the grip device of the present invention comprises a cylindrical body 10 and two cylindrical rotary members 20. The body 10 has two opposite ends, and each of the two opposite ends has an engaging portion 100 formed thereto. Each engaging portion 100 includes multiple recesses 11 which have different sizes and are located around the axis of the body 10. Each recess 11 a pentagonal recess so as to accommodate a hexagonal wrench therein. Each recess 11 includes a top opening 112, an inner end 113 and an outside portion 114. The inner end 113 has a first slot 111 defined therein. The outside portion 114 has an end opening 115. The top opening 112 is defined in the outside of the engaging portion 100. The end opening 115 is defined in the end face 12 of the engaging portion 100. The cross section of the first slot 111 is matched with the cross section of the recess 11. The correspondent first slots 111 of the two engaging portions 100 communicate with each other. An axle 13 extends from the center of the end face 12 and has a connection portion 14 with inner threads.

A rotary member 20 is mounted to the engaging portion 100 and has a first end 200 and a second end 201 which is located opposite to the first. end 200. An engaging slot 22 is defined in the outside of the rotary member 2.0, and the engaging slot 22 is a pentagonal slot 22. The first end 200 faces the end face 12 of the body 10. The rotary member 20 includes a passage 21 defined axially therethrough, and the axle 13 extends through the passage 21. The rotary member 20 is rotatable relative to the axle 13 and movable along the axle 13 such that the pentagonal slot 22 is located in alignment with one of the recesses 11. The pentagonal slot 22 is sized to be equal to one of the recesses 11 that has the maximum size among the recesses 11. A first face 221, a second face 222 and a third face 223 extend from the rear position 2201 of the inner face 220 of the pentagonal slot 22, and the first, second and third faces 221, 222 and 223 extend from the first end 200 toward the second end 201 inclinedly in sequence. The slope of the third face 223 is larger than the slop of the first face 221. The slop of the first face 221 is larger than the slop of the second face 222. A fourth face 224 extends from the distal end of the third face 223 and is perpendicular to the axis of the rotary member 20. The passage 21 includes a first room 23 and a second room 25 respectively defined in the inner periphery thereof. The inner diameter of the first room 23 is larger than the inner diameter of the passage 21. A first shoulder 24 is formed between the first room 23 and the passage 21. A third room 27 is defined in the inner periphery of the passage 21. The inner diameter of the third room 27 is larger than the inner diameter of the second room 25. A second shoulder 26 is formed between the second and third rooms 25, 27. The third room 27 is defined through the second end 201 of the rotary member 20. A cover SO is mounted to the first room 23 so as to hide the resilient member 30 and the fastening member 40 in the rotary member 20. The cover 50 includes a restriction portion 51 which is in contact with the inner periphery of the second room 25 so that the enlarged head of the cover 50 contacts the second shoulder 26.

A resilient member 30 and a fastening member 40 are located in the first room 23. The resilient member 30 is mounted to the axle 13 and the fastening member 40 is connected to the connection portion 14. The resilient member 30 is biased between the first shoulder 24 and the head 41 of the fastening member 40.

Figure 7:
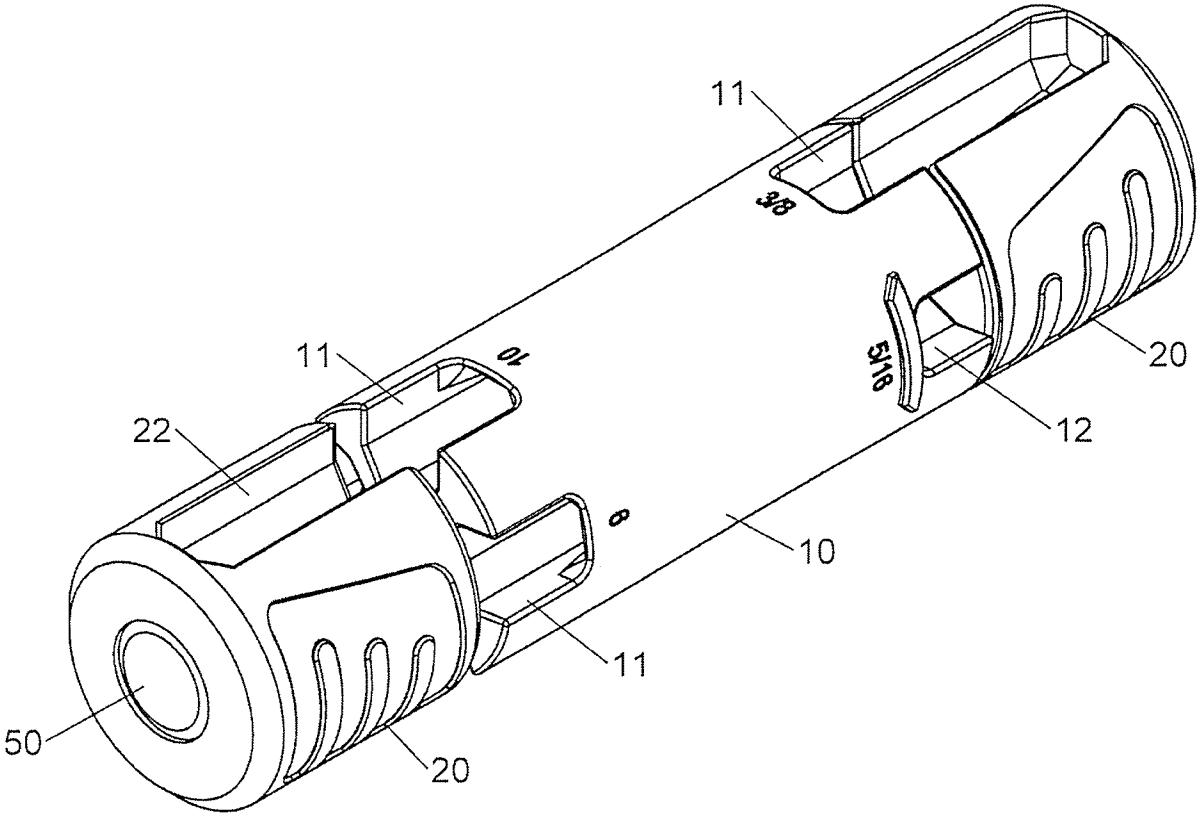
FIG. 7 shows the second operational status of the grip device of the present invention.
Figure 9:
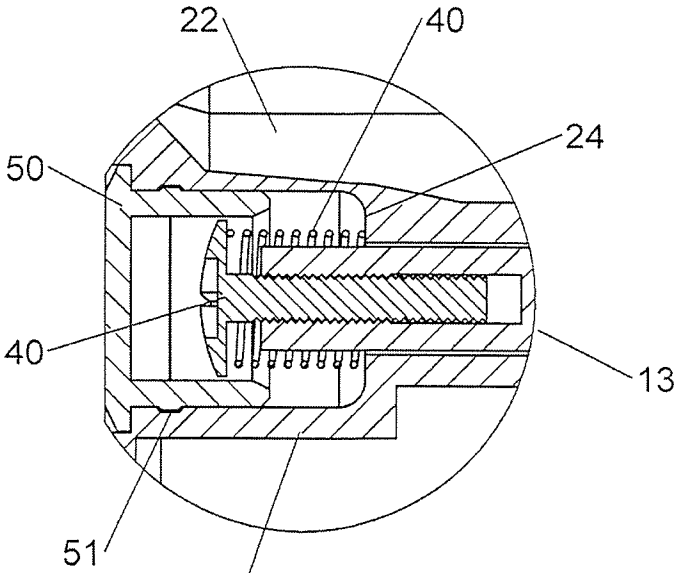
FIG. 9 is an enlarged view of the circled "B" in FIG. 8.
Figure 8:
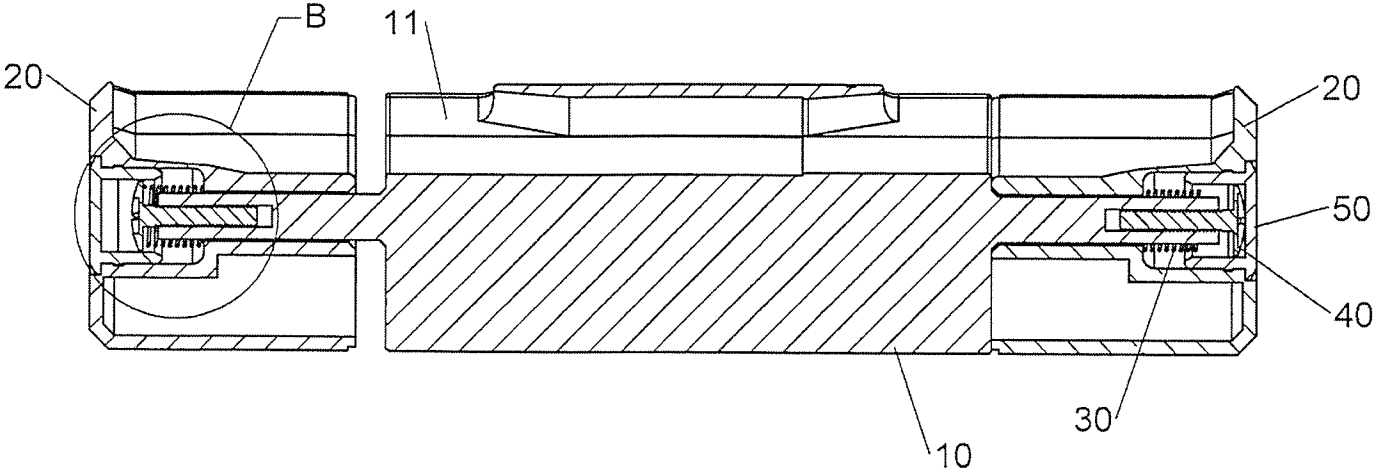
FIG. 8 is a cross sectional view to show the second operational status of the grip device of the present invention.

As shown in FIGS. 7 to 9, when the rotary member 20 is moved away from the engaging portion 100, and the first end 200 of the rotary member 20 is separated from the end face 12 of the body 10, the resilient member 30 is compressed.

Figure 10:
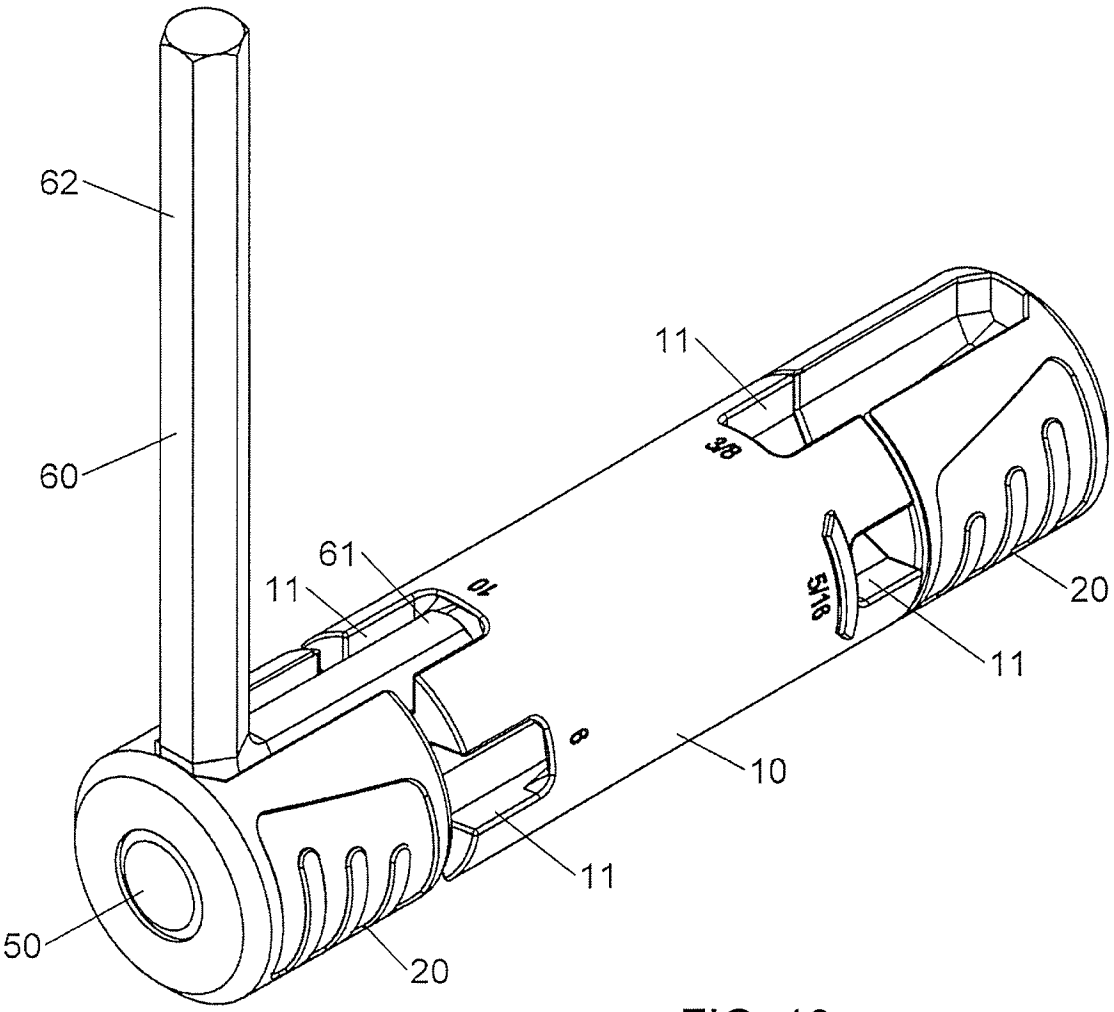
FIG. 10 shows the third operational status of the grip device of the present invention.
Figure 11:
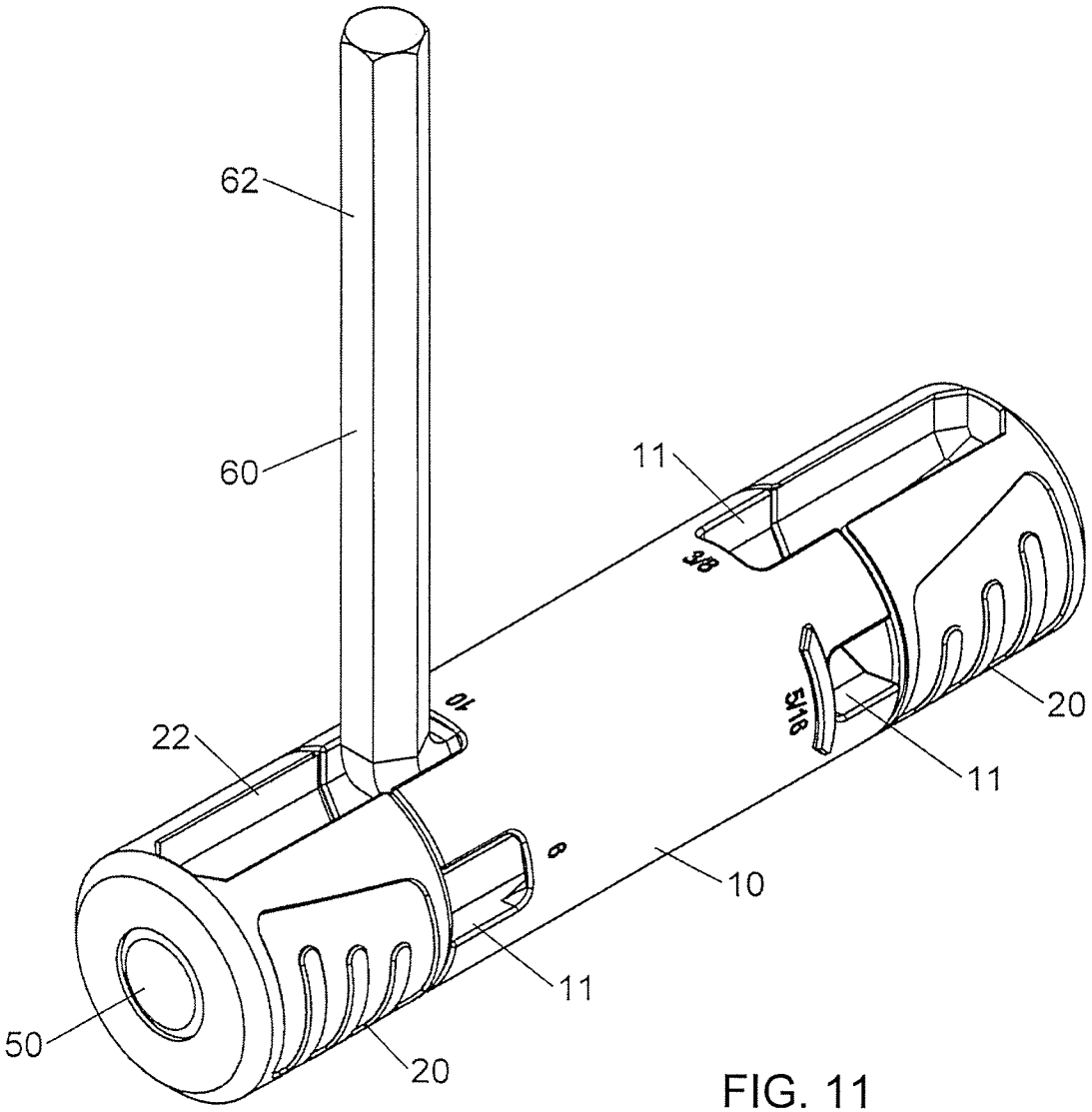
FIG. 11 shows the fourth operational status of the grip device of the present invention.
Figure 12:
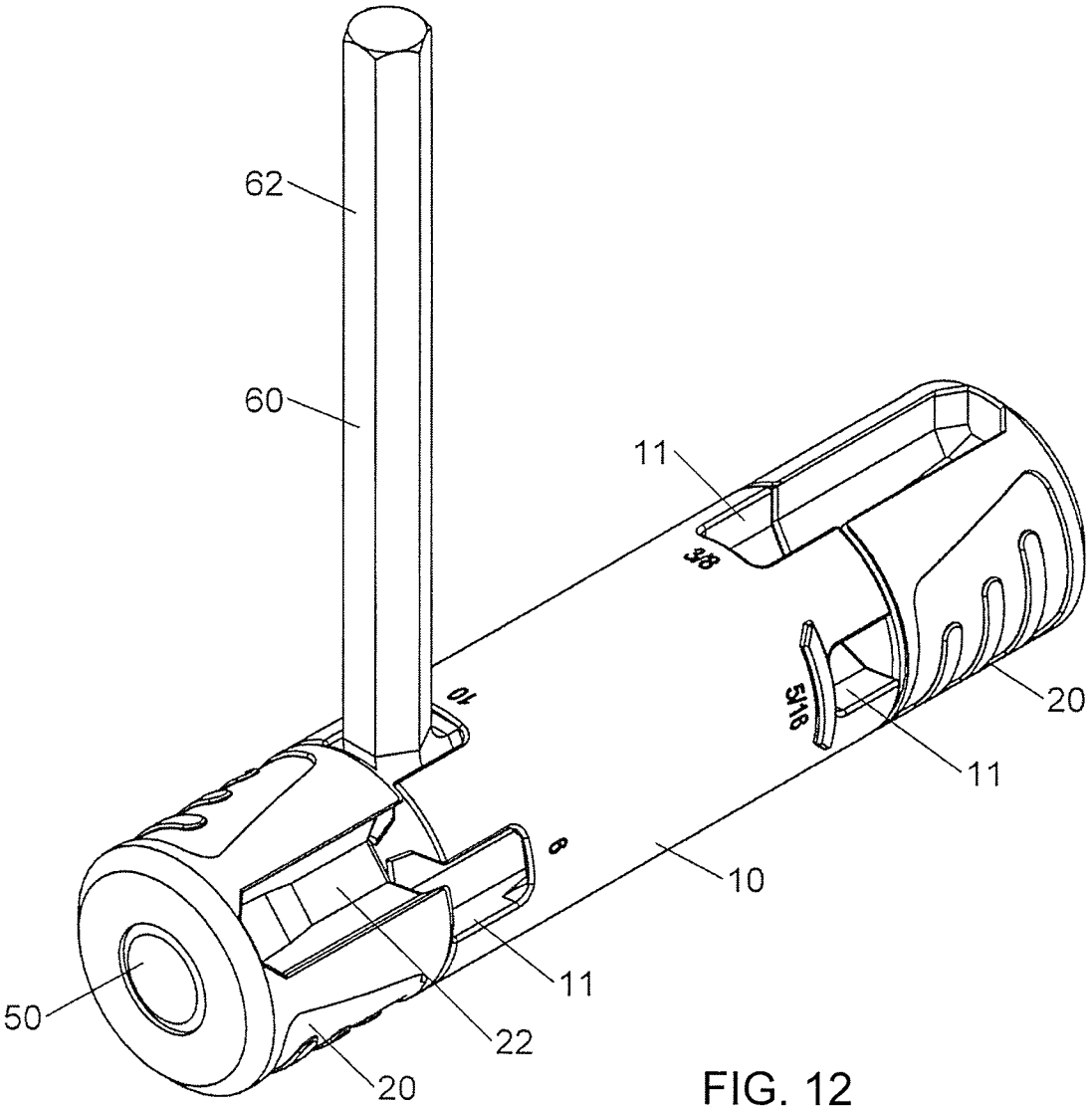
FIG. 12 shows the fifth operational status of the grip device of the present invention.

As shown in FIGS. 10 to 12, an L-shaped tool 60 includes a first section 61 and a second section 62 which extends from the first section 61 at an angle. The second section 62 is longer than the first section 61 as shown in FIG. 10. When the rotary member 20 is moved away from the engaging portion 100. and the first end 200 of the rotary member 20 is separated from the end face 12 of the body 10, the first section 61 is accommodated in the engaging slot 22 and one of the recesses 11 as shown in FIG. 10. The first, second, third and fourth faces 221, 222, 223, 224 are respectively located corresponding to the turning position between the first and second sections 61, 62. When the rotary member 20 is moved toward the engaging portion 100, and the first end 200 of the rotary member 20 is in contact with the end face 12 of the body 10 by the recovery force of the resilient member 30, the first section 61 is pushed by the rotary member 20 and is inserted into the first slot 111 as shown in FIG. 11. When the rotary member 20 is rotated relative to the engaging portion 100 to shift the engaging slot 22 away from the recess 11, the first end 200 of the rotary member 20 seals the end opening 115 of the recess 11, and the L-shaped tool 60 is restricted by the rotary member 20 and is not disengaged from the body 10 as shown in FIG. 12. By rotating the body 10. the tool 60 is rotated to output torque. The tool 60 is stably and firmly operated by holding and rotating the body 10.

Figure 13:
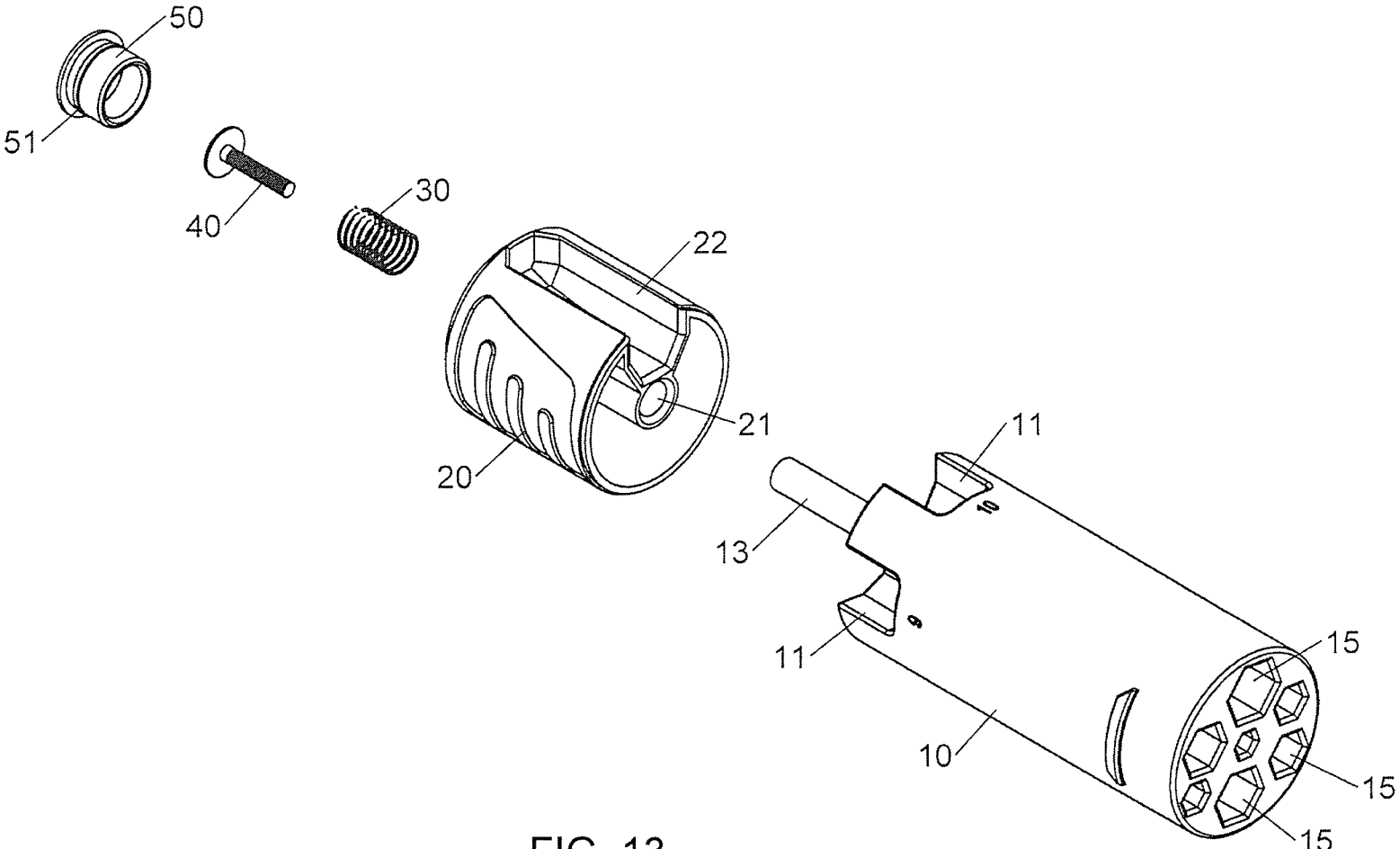
FIG. 13 is an exploded view of the second embodiment of the grip device of the present invention.

As shown in FIG. 13, the second embodiment of the grip device of the present invention is disclosed, multiple second slots 15 of different sizes are defined in the other one of the two opposite ends of the body 10 that does not have the engaging portion 100.

The advantages of the present invention are that when the tool 60 is engaged with the first slot 111, and the rotary member 20 is rotated to seal the recess 11 such that the tool 60 is restricted by the rotary member 20 and is not disengaged from the body 10. Therefore, the tool 60 is stably and firmly operated by holding and rotating the body 10.

The rotary member 20 is pushed by the resilient force of the resilient member 30 to contact the end face 12 of the body 10. When rotating the body and driving the tool 60, the rotational force cannot make the rotary member 20 to rotate and shift relative to the end face 12 of the body 10. The resilient member 30 always applies a force to the rotary member 20, and there are two steps required to rotate the rotary member 20. Therefore, the rotary member 20 is safe and reliable.

As shown in FIGS. 7 and 10, when the rotary member 20 is moved away from the engaging portion 100 and movable along the axle 13, the first shoulder 24 compresses the resilient member 30 which is then compressed. The first end 200 of the rotary member 20 is separated from the end face 12 of the body 10. The first section 61 is accommodated in the engaging slot 22 and one of the recesses 11. Then the rotary member 20 is moved toward the engaging portion 100, and the first end 200 of the rotary member 20 is in contact with the end face 12 of the body 10 by the recovery force of the resilient member 30. The first section 61 is pushed by the rotary member 20 and is inserted into the first slot 111. When the rotary member 20 is rotated relative to the engaging portion 100 to shift the engaging slot 22 away from the recess 11, the first end 200 of the rotary member 20 seals the end opening 115 of the recess 11, and the L-shaped tool 60 is restricted by the rotary member 20 and is not disengaged from the body 10.

Figure 2:
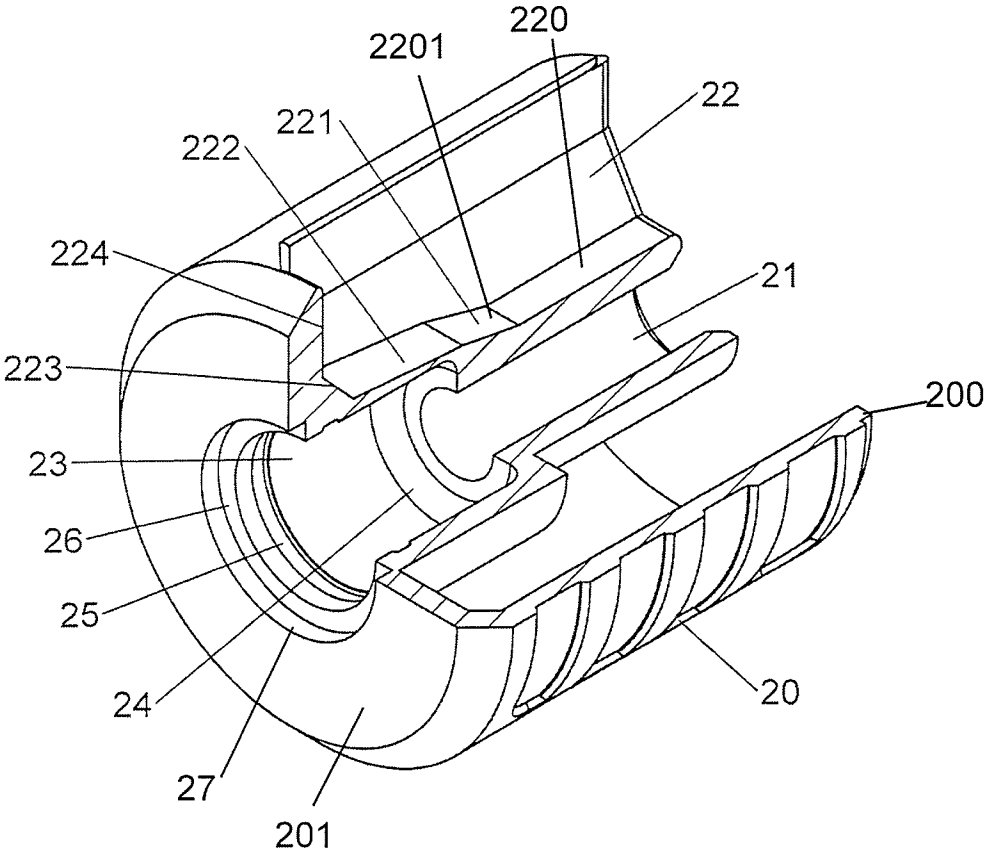
FIG. 2 is a perspective view to show the rotary member of the grip device of the present invention.
Figure 3:
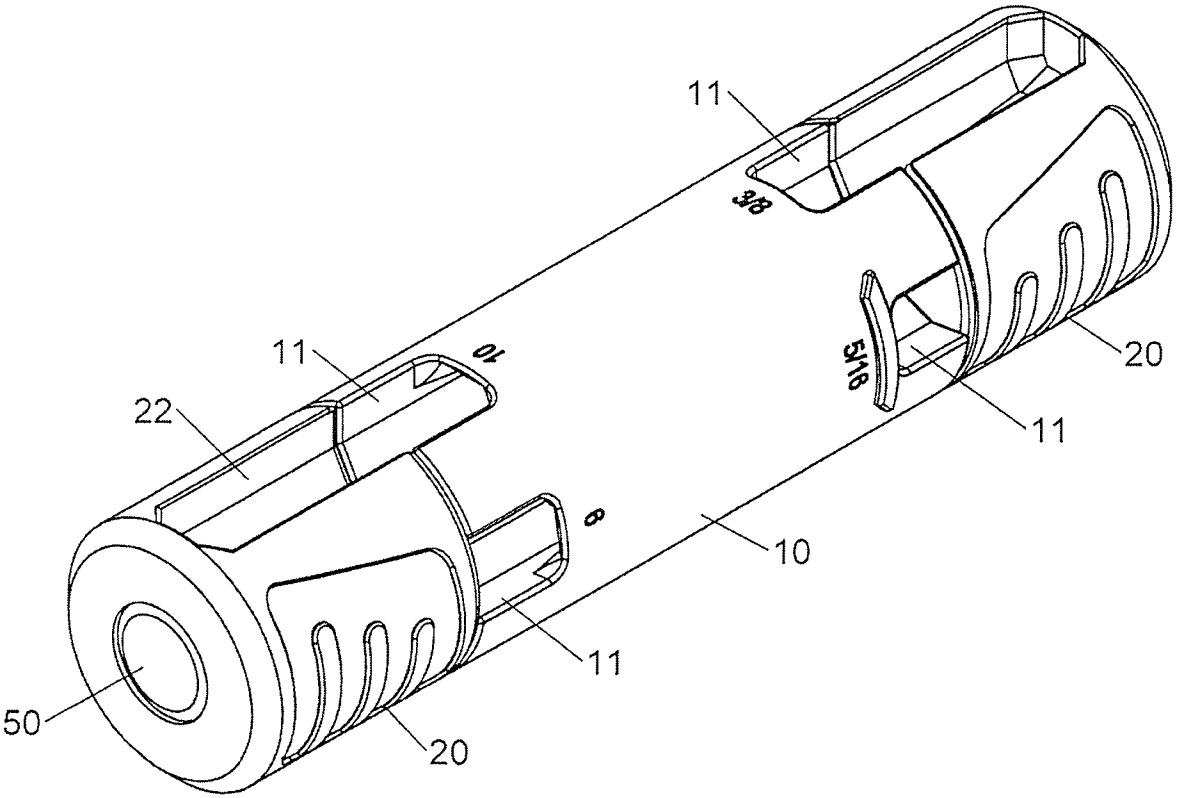
FIG. 3 is a perspective view to show the grip device of the present invention.
Figure 4:
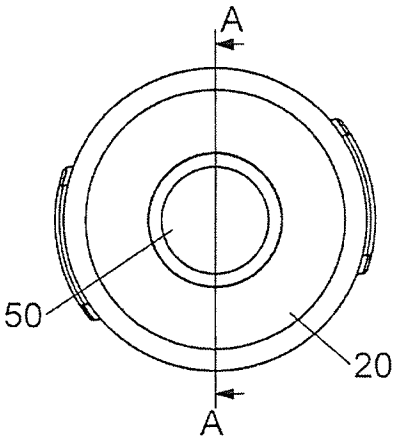
FIG. 4 is a front view of the grip device of the present invention.
Figure 6:
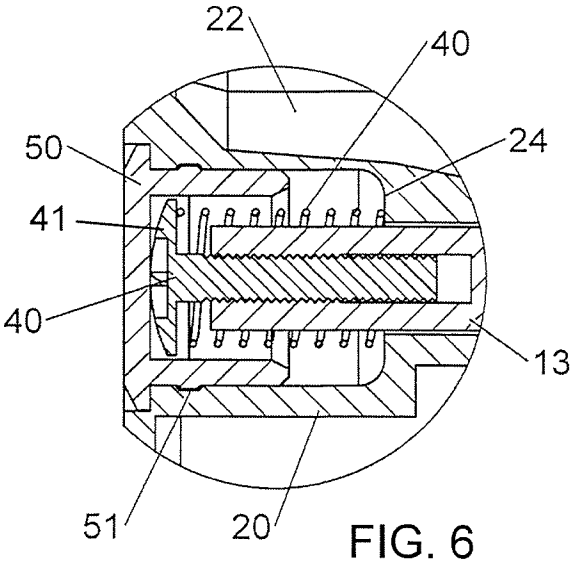
FIG. 6 is an enlarged view of the circled "B" in FIG. 5.
Figure 5:
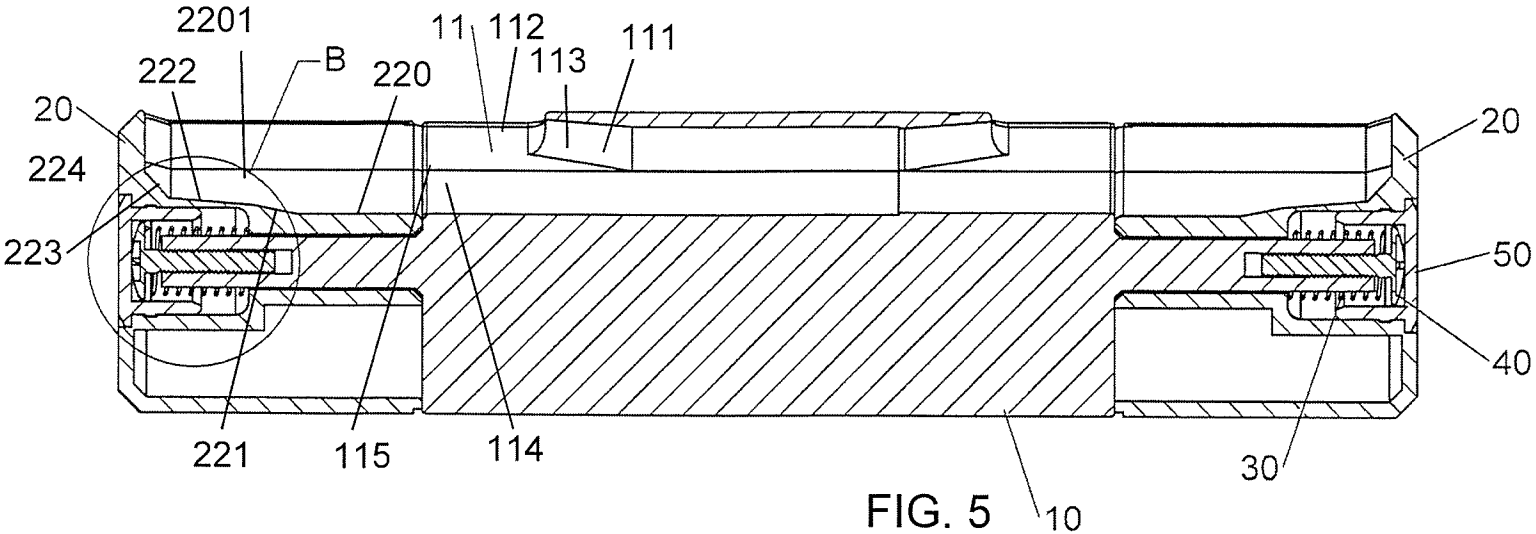
FIG. 5 is a cross sectional view, taken along line A-A in FIG. 4.

As shown in FIG. 2, the first, second, third and fourth faces 221, 222, 223, 224 are respectively located corresponding to the turning position between the first and second sections 61, 62, such that the tool 60 is easily engaged with the engaging slot 22 and the recess 11.

The recesses 11 of the body 10 have different sizes, and the engaging slot 22 of the rotary member 20 is able to be in alignment with each of the recesses 11. The pentagonal slot 22 is sized to be equal to one of the recesses 11 that has the maximum size. The grip device may be connected with the tools 60 of different sizes.

While we have shown and described the embodiment in accordance with the present invention, it should be clear to those skilled in the art that further embodiments may be made without departing from the scope of the present invention.

What is claimed is:

1. A grip device for hexagonal wrenches, comprising:

a body having two opposite ends, at least one of the two opposite ends having an engaging portion formed thereto, the engaging portion including multiple recesses which have different sizes and are located around an axis of the body, each recess being a pentagonal recess so as to accommodate a hexagonal wrench therein, each recess including a top opening, an inner end and an outside portion, the inner end having a first slot defined therein, the outside portion having an end opening, the top opening defined in an outside of the engaging portion, the end opening defined in an end face of the engaging portion, a cross section of the first slot being matched with a cross section of the recess, an axle extending from a center of the end face and having a connection portion with inner threads;

a rotary member mounted to the engaging portion and having a first end and a second end which is located opposite to the first end, an engaging slot defined in an outside of the rotary member, the engaging slot being a pentagonal slot, the first end facing the end face of the body, the rotary member including a passage defined axially therethrough, the axle extending through the passage, the rotary member rotatable relative to the axle and movable along the axle such that the pentagonal slot is located in alignment with one of the recesses, the pentagonal slot being sized to be equal to one of the recesses that has a maximum size, a first face, a second face and a third face extending from a rear position of an inner face of the pentagonal slot, the first, second and third faces extending from the first end toward the second end inclinedly in sequence, the passage including a first room and a second room respectively defined in an inner periphery thereof, an inner diameter of the first room being larger than an inner diameter of the passage, a first shoulder formed between the first room and the passage, and a resilient member and a fastening member located in the first room, the resilient member mounted to the axle and the fastening member connected to the connection portion, the resilient member biased between the first shoulder and a head of the fastening member, when the rotary member is moved away from the engaging portion, and the first end of the rotary member is separated from the end face of the body, the resilient member is compressed.

2. The grip device for hexagonal wrenches as claimed in claim 1, wherein the body is a cylindrical body.

3. . The grip device for hexagonal wrenches as claimed in claim 1, wherein the two opposite ends of the body each have the engaging portion formed thereto, each of the engaging portion has the rotary member mounted thereto, the recesses of one the two engaging portions correspondingly communicate with the recesses of the other one the two engaging portions.

4. . The grip device for hexagonal wrenches as claimed in claim 1, wherein a slope of the third face is larger than a slop of the first face, the slop of the first face is larger than a slop of the second face, a fourth face extends from a distal end of the third face and is perpendicular to an axis of the rotary member.

5. The grip device for hexagonal wrenches as claimed in claim 1, wherein a third room is defined in the inner periphery of the passage, an inner diameter of the third room is larger than an inner diameter of the second room, a second shoulder is formed between the second and third rooms, the third room is defined through the second end of the rotary member, a cover is mounted to the first room so as to hide the resilient member and the fastening member in the rotary member, the cover includes a restriction portion which is in contact with the inner periphery of the second room so that an enlarged head of the cover contacts the second shoulder.

6. The grip device for hexagonal wrenches as claimed in claim 1 further comprising an L-shaped tool which includes a first section and a second section which extends from the first section at an angle, the second section is shorter than the first section, when the rotary member is moved away from the engaging portion, and the first end of the rotary member is separated from the end face of the body, the first section is accommodated in the engaging slot and one of the recesses, when the rotary member is moved toward the engaging portion, and the first end of the rotary member is in contact with the end face of the body, the first section is inserted into the first slot, when the rotary member is rotated relative to the engaging portion to shift the engaging slot away from the recess, the first end of the rotary member seals the end opening of the recess, the L-shaped tool is restricted by the rotary member and is not disengaged from the body.

7. The grip device for hexagonal wrenches as claimed in claim 1, wherein multiple second slots of different sizes are defined in the other one of the two opposite ends of the body that does not have the engaging portion.

* * * * *